US006725190B1

(12) United States Patent
Chazan et al.

(10) Patent No.: US 6,725,190 B1
(45) Date of Patent: Apr. 20, 2004

(54) METHOD AND SYSTEM FOR SPEECH RECONSTRUCTION FROM SPEECH RECOGNITION FEATURES, PITCH AND VOICING WITH RESAMPLED BASIS FUNCTIONS PROVIDING RECONSTRUCTION OF THE SPECTRAL ENVELOPE

(75) Inventors: Dan Chazan, Haifa (IL); Gilad Cohen, Haifa (IL); Ron Hoory, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/432,081

(22) Filed: Nov. 2, 1999

(51) Int. Cl.[7] ..... G10L 19/02
(52) U.S. Cl. ..... 704/205; 704/203
(58) Field of Search ..... 704/208, 203, 704/214, 205, 207

(56) References Cited

U.S. PATENT DOCUMENTS

| | | | | | |
|---|---|---|---|---|---|
| 4,797,926 | A | * | 1/1989 | Bronson et al. | 704/214 |
| 5,077,798 | A | * | 12/1991 | Ichikawa et al. | 704/222 |
| 5,377,301 | A | * | 12/1994 | Rosenberg et al. | 704/222 |
| 5,384,891 | A | * | 1/1995 | Asakawa et al. | 704/220 |
| 5,485,543 | A | * | 1/1996 | Aso | 704/267 |
| 5,774,837 | A | * | 6/1998 | Yeldener et al. | 704/208 |
| 5,787,387 | A | * | 7/1998 | Aguilar | 704/208 |
| 5,839,098 | A | * | 11/1998 | Laroia et al. | 704/203 |
| 5,956,683 | A | * | 9/1999 | Jacobs et al. | 704/270.1 |
| 6,052,658 | A | * | 4/2000 | Wang et al. | 704/205 |

OTHER PUBLICATIONS

Koishida et al., "Celp Coding Based on Mel–Cepstral Analysis", *IEEE International Conference on Acoustics, Speech and Signal Processing—Preceedings*, vol. 1, pp. 33–36, (1995).

(List continued on next page.)

*Primary Examiner*—Marsha D. Banks-Harold
*Assistant Examiner*—Donald L. Storm
(74) *Attorney, Agent, or Firm*—Browdy and Neimark, P.L.L.C.

(57) ABSTRACT

A speech reconstruction method and system for converting a series of binned spectra or functions thereof such as the Mel Frequency Cepstra Coefficients (MFCC), of an original digitized speech signal, into a reconstructed speech signal, where each binned spectrum has a respective pitch value and voicing decision. The binned spectra are derived from the original digitized speech signal at successive instances by multiplying each estimate of the spectral envelope by a predetermined set of frequency domain window functions and computing the integrals thereof. At each respective time instance, harmonic frequencies and weights are generated according to the respective pitch value and voicing decision. Basis functions having bounded supports on the frequency axis are each sampled at all said harmonic frequencies, which are within its support and multiplied by respective harmonic weights. The sampled basis functions are combined with respective phases, generated according to the pitch value, voicing decision and possibly the binned spectrum, resulting in a complex line spectrum corresponding to each basis function. Coefficients are generated of the basis functions, and each of the points of the respective complex line spectra is multiplied by the respective basis function coefficient. The complex line spectra are summed up to generate for each time instance a single complex line spectrum with values for all harmonic frequencies. A time signal is generated from complex line spectra computed at successive instances of time.

24 Claims, 5 Drawing Sheets

OTHER PUBLICATIONS

Stylianou et al., "Continuous Probabilistic Transform for Voice Conversion", *IEEE Transaction on Speech and Audio Processing*, vol. 6, No. 2, pp. 131–142, (1998).

McAulay, "Speech Analysis/Synthesis Based on a Sinusoidal Representation", *IEEE Transaction on Acoustics, Speech and Signal Proceeding*, vol. 34, No. 4, pp. 744–754, (1986).

Almeida et al., "Variable–Frequency Synthesis: An Improved Coding Scheme", *Proc. ICASSP*, pp237–244, (1984).

McAulay et al., "Sinusoidal Coding", *Speech Coding and Synthesis*, chapter 4, pp. 121–173, (1995).

Davis et al., "Comparison of Parametric Representation for Monosyllabic Word Recognition in Continuously Spoken Sentences", *IEEE Transaction on Acoustics, Speech, and Signal Processing*, vol. 28, No. 4, pp. 357–367 (1980).

* cited by examiner

10

METHOD AND SYSTEM FOR SPEECH RECONSTRUCTION FROM SPEECH RECOGNITION FEATURES, PITCH AND VOICING WITH RESAMPLED BASIS FUNCTIONS PROVIDING RECONSTRUCTION OF THE SPECTRAL ENVELOPE

RELATED APPLICATION

This application is related to co-pending application Ser. No. 09/410,085 entitled "Low bit-rate speech coding system and method using speech recognition features", filed Oct. 1, 1999 by Ron Hoory et al. and assigned to the present assignee.

FIELD OF THE INVENTION

This invention relates generally to speech recognition for the purpose of speech to text conversion and, in particular, to speech reconstruction from speech recognition features.

REFERENCES

In the following description reference is made to the following publications:

[1] Kazuhito Koishida, Keiichi Tokuda, Takao Kobayashi, Satoshi Imai, "*Celp Coding Based on Mel Cepstral Analysis*", Speech ICASSP, IEEE International Conference on Acoustics, Speech and Signal Processing—Proceedings v 1 1995. IEEE, Piscataway, N.J. [See definition of Mel Cesptrum on page 33].

[2] Stylianou, Yannis Cappe, Olivier Moulines, Eric, "*Continuous probabilistic transform for voice conversion*", IEEE Transactions on Speech and Audio Processing v 6 n 2 March 1998. pp131–142 [See page 137 defining the cepstral parameters c(i)].

[3] McAulay, R. J. Quatieri, T. F. "Speech *Analysis-Synthesis Based on a Sinusoidal Representation*", IEEE Trans.Acoust. Speech, Signal Processing Vol. ASSP-34, No. 4, August 1986.

[4] L. B. Almeida, F. M. Silva, "*Variable-Frequency Synthesis: An improved Harmonic Coding Scheme*", Proc ICASSP pp237–244 1984.

[5] McAulay, R. J. Quatieri, T. F. "*Sinusoidal Coding in Speech Coding and Synthesis*", W. Kleijn and K. Paliwal Eds., Elsevier 1995 ch. 4.

[6] S. Davis and P. Mermelstein, "Comparison of parametric representations for monosyllabic word recognition in continuously spoken sentences", IEEE Trans ASSP, Vol. 28, No. 4, pp. 357–366, 1980.

BACKGROUND OF THE INVENTION

All speech recognition schemes for the purpose of speech to text conversion start by converting the digitized speech to a set of features that are then used in all subsequent stages of the recognition process. These features, usually sampled at regular intervals, extract in some sense the speech content of the spectrum of the speech signal. In many systems, the features are obtained by the following three-step procedure:

(a) deriving at successive instances of time an estimate of the spectral envelope of the digitized speech signal, (b) multiplying each estimate of the spectral envelope by a predetermined set of frequency domain window functions, wherein each window is non-zero over a narrow range of frequencies, and computing the integrals thereof, and (c) assigning the computed integrals or a set of predetermined functions thereof to respective components of a corresponding feature vector in a series of feature vectors.

The center of mass of successive weight functions are monotonically increasing. A typical example is the Mel Cepstrum, which is obtained by a specific set of weight functions that are used to obtain the integrals of the products of the spectrum and the weight functions at step (b). These integrals are called 'bin' values and form a binned spectrum. The truncated logarithm of the binned spectrum is then computed and the resulting vector is cosine transformed to obtain the Mel Cepstral values.

There are a number of applications that require the ability to reproduce the speech from these features. For example, the speech recognition may be carried out on a remote server, and at some other station connected to that server it is desired to listen to the original speech. Because of channel bandwidth limitation, it is not possible to send the original speech signal from the client device used as an input device to the server and from that server to another remote client device. Therefore, the speech signal must be compressed. On the other hand, it is imperative that the compression scheme used to compress the speech will not affect the recognition rate.

An effective way to do that is to simply send a compressed version of the recognition features themselves, as it may be expected that all redundant information has been already removed in generating these features. This means that an optimal compression rate can be attained. Because the transformation from speech signal to features is a many-to-one transformation, i.e. it is not invertible, it is not evident how the reproduction of speech from features can be carried out, if at all.

To a first approximation, the speech signal at any time can assumed to be voiced, unvoiced or silent. The voiced segments represent instances where the speech signal is nearly periodic. For speech signals, this period is called pitch. To measure the degree to which the signal can be approximated by a periodic signal, 'windows' are defined. These are smooth functions e.g. hamming functions, whose width is chosen to be short enough so that inside each window the signal may be approximated by a periodic function. The purpose of the window function is to discount the effects of the drift away from periodicity at the edges of the analysis interval. The window centers are placed at regular intervals on the time axis. The analysis units are then defined to be the product of the signal and the window function, representing frames of the signal. On each frame, the windowed square distance between the true spectrum and its periodic approximation may serve as a measure of periodicity. It is well known that any periodic signal can be represented as a sum of sine waves that are periodic with the period of the signal. Each sine wave is characterized by its amplitude and phase. For any given fundamental frequency (pitch) of the speech signal, the sequence of complex numbers representing the amplitudes and phases of the coefficients of the sine waves will be referred to as the "line spectrum". It turns out that it is possible to compute a line spectrum for speech that contains enough information to reproduce the speech signal so that the human ear will judge it almost indistinguishable from the original signal (Almeida [4], McAuley et al. [5]). A particularly simple way to reproduce the signal from the sequence of line spectra corresponding to a sequence of frames, is simply to sum up the sine waves for each frame, multiply each sum by its window, add these signal segments over all frames to obtain segments of reconstructed speech of arbitrary length. This procedure will be effective if the windows sum up to a roughly constant time function.

The line spectrum can be viewed as a sequence of samples at multiples of the pitch frequency of a spectral envelope representing the utterance for the given instant. The spectral envelope represents the Fourier transform of the infinite impulse response of the mouth while pronouncing that utterance. The essential fact about a line spectrum is that if it represents a perfectly periodic signal whose period is the pitch, the individual sine waves corresponding to particular frequency components over successive frames are aligned, i.e. they have the precise same value at every given point in time, independent of the source frame. For a real speech signal, the pitch varies from one frame to another. For this reason, the sine waves resulting from the same frequency component for successive frames are only approximately aligned. This is in contrast to the sine waves corresponding to components of the discrete Fourier transform, which are not necessarily aligned individually from one frame to the next. For unvoiced intervals, a pitch equal to the Fourier analysis interval is arbitrarily assumed. It is also known that given only the set of absolute values of the line spectral coefficients, there are a number of ways to generate phases (McAuley [3], [5]), so that the signal reproduced from the line spectrum having the given amplitudes and the computed phases, will produce speech of very acceptable resemblance to the original signal.

Given any approximation of the spectral envelope, a common way to compute features is the so-called Mel Cepstrum. The Mel Cepstrum is defined through a discrete cosine transform (DCT) on the log Mel Spectrum. The Mel Spectrum is defined by a collection of windows, where the $i^{th}$ window (i=0,1,2, . . . ) is centered at frequency f(i) where f(i)=MEL(a·i) and f(i+1)>f(i). The function MEL(f) is a convex non-linear function of f whose derivative increases rapidly with f. The numbers (a·i) can be viewed as representing Mel Frequencies. The value of a is chosen so that if N is the total number of Mel frequencies, MEL(a·N) is the Nyquist frequency of the speech signal. The window used to generate the $i^{th}$ component of the Mel Spectrum is defined to have its support on the interval [f(i−1),f(i+1)] and to be a hat function consisting of two segments, which are linear in Mel frequency. The first, ascending from f(i−1) to f(i), and the second, descending from f(i) to f(i+1). The value of the $i^{th}$ component of the Mel Spectrum is obtained by multiplying the $i^{th}$ window by the absolute value of discretely sampled estimate of the spectral envelope, and summing the result. The resulting components can be viewed as partitioning the spectrum into frequency bins that group together the spectral components within the window through the weighted summation. To obtain the Mel Cepstrum, the bins are increased if necessary to be always larger than some small number, and the log of the result is taken. The discrete cosine transform of the sequence of logs is computed, and the first L transform coefficients (L≦N) are used to represent the Mel Cepstrum.

From what is said above, in order to reproduce the signal from the Mel Cepstrum, it is necessary to estimate the absolute values of the line spectrum, combine those with the synthetically generated phases, sum up the sine components, multiply that sum by the time window and overlap add the results. What is needed therefore is a way to obtain the line spectrum from the Mel-Cepstrum.

Tokuda et al. [1] propose some procedure for reproducing the spectrum from the Mel Cepstrum. However their definition of the Mel Cepstrum is rather restrictive, and is not in line with some of the features used in today's existing speech recognition systems. Rather than performing a simple integration on the spectrum of the signal, the definition used by them is based on an iterative procedure that is optimal in terms of some error measure. The spectral estimation procedure proposed by them has as it is defined today no latitude for other methods for computing the cepstrum.

Stylianou et al. [2] also present a technique for spectral reconstruction from cepstral like parameters. Again the definition of Cepstrum is quite specific, and is chosen to allow spectral reconstruction a priori rather than use very simply computed integrated Mel Cepstral parameters which are presently in use in many speech recognition systems.

SUMMARY OF THE INVENTION

It is therefore an object of the invention to provide an improved method for spectral reconstruction from Cepstral like parameters that can use a wide class of spectral representations including those commonly used in today's speech recognition systems.

This object is realized in accordance with a broad aspect of the invention by a speech reconstruction method for converting a series of binned spectra or functions thereof which will be referred to as "feature vectors" and a series of respective pitch values and voicing decisions of an original input speech signal into a speech signal, the feature vectors being obtained as follows:

(i) deriving at successive instances of time an estimate of a spectral envelope SE(i), i being a frequency index, of the digitized original speech signal, (ii) multiplying each estimate of the spectral envelope by a predetermined set of frequency domain window functions, BW(i,k), i being a frequency index and k being the window function index, wherein each window is non-zero over a narrow range of frequencies, and computing the integrals thereof, according to the expression:

$$BI(k) = \sum_i SE(i) \cdot BW(i, k),$$

where BI(k) is defined as the $k^{th}$ component of a "binned spectrum", and (iii) assigning said integrals or a set of pre-determined functions thereof to respective components of a corresponding feature vector in a series of feature vectors;

said speech reconstruction method comprising:

(a) converting each feature vector into a binned spectrum in some consistent manner, (b) generating harmonic frequencies and weights according to the corresponding pitch and voicing decision, (c) generating for each harmonic frequency a respective phase, depending on the corresponding pitch value and voicing decision and possibly on the binned spectrum, (d) sampling each of the basis functions at all harmonic frequencies which are within its support, the support of the basis functions being bounded, and multiplying by the respective harmonic weight, so as to produce for each sampled basis function a respective line spectrum having multiple components, (e) combining each component of each respective line spectrum with the respective phase thereof so as to produce a complex line spectrum for each basis function, (f) generating gain coefficients of the basis functions, (g) multiplying each of the points of the complex line spectrum of each basis function by the respective basis function gain coefficient and summing up all resulting complex line spectra to generate a single complex line spectrum having a respective component for each of the harmonic frequencies, and (h) generating a time signal from complex line spectra computed at successive instances of time.

The principal novelty of the invention resides in the representation of the line spectrum of the output signal spectrum in terms of a non-negative linear combination of sampled narrow support basis functions, whilst maintaining the condition that the reproduced spectrum will have bins that are close to those of the original signal. This also embraces the particular case in which the envelope is computed by simply taking the absolute values of the Fourier transform of a windowed segment of the signal, wherein that same process is mimicked in the generation of the equations expressing the condition that the bins of the result are close to those of the original signal.

In the preferred embodiment described below, the complex spectrum of each basis function is converted to a windowed discrete Fourier transform. This is done by a convolution with the analysis window Fourier transform. Consequently, the linear combination at step (g) above is carried out directly on the windowed DFTs, to produce a windowed DFT, corresponding to a single frame of speech.

BRIEF DESCRIPTION OF THE DRAWINGS

In order to understand the invention and to see how it may be carried out in practice, a preferred embodiment will now be described, by way of non-limiting example only, with reference to the drawings, in which.

DETAILED DESCRIPTION OF A PREFERRED EMBODIMENT

Figure 1:
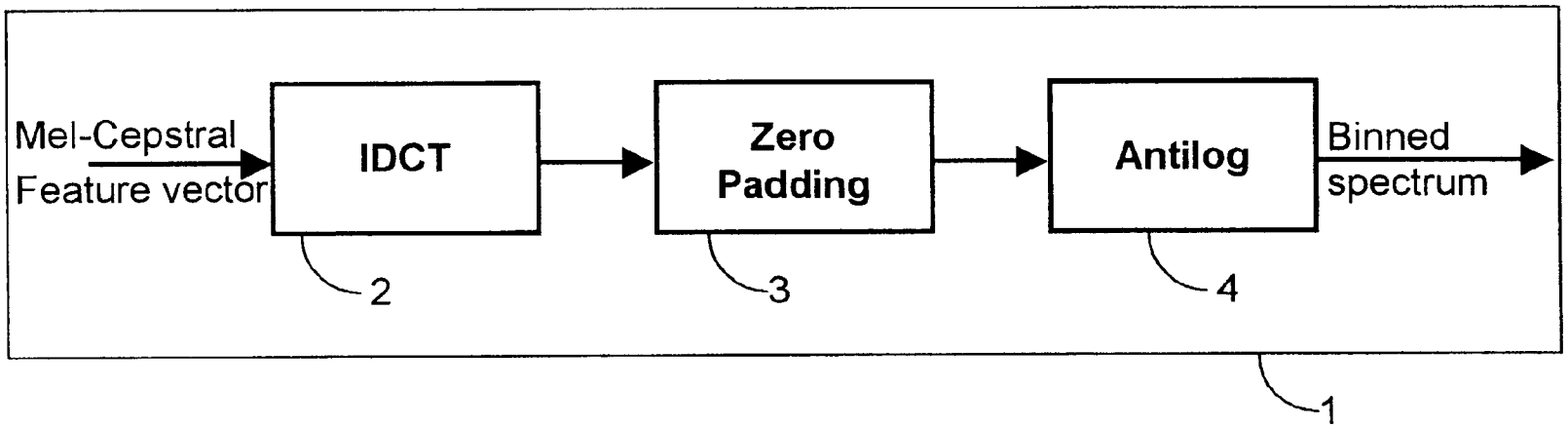
FIG. 1 is a block diagram showing functionally a conversion unit for converting the mel-cepstral feature vectors into binned spectra.

In the preferred embodiment, Mel-Cepstral feature vectors are assumed to be used. FIG. 1 is a block diagram showing a system 1 for constructing binned spectra from the Mel-Cepstral feature vectors. For each feature vector, an inverse discrete cosine transform (IDCT) unit 2 calculates the IDCT of the available Mel Cepstral components. If the number of total transform coefficients is greater than the number of Cepstral components actually used, a zero padding unit 3 adds zeros to the Mel Cepstral coefficients. An antilog unit 4 calculates the antilog of the resulting components thereby yielding a binned spectrum.

Figure 2A:
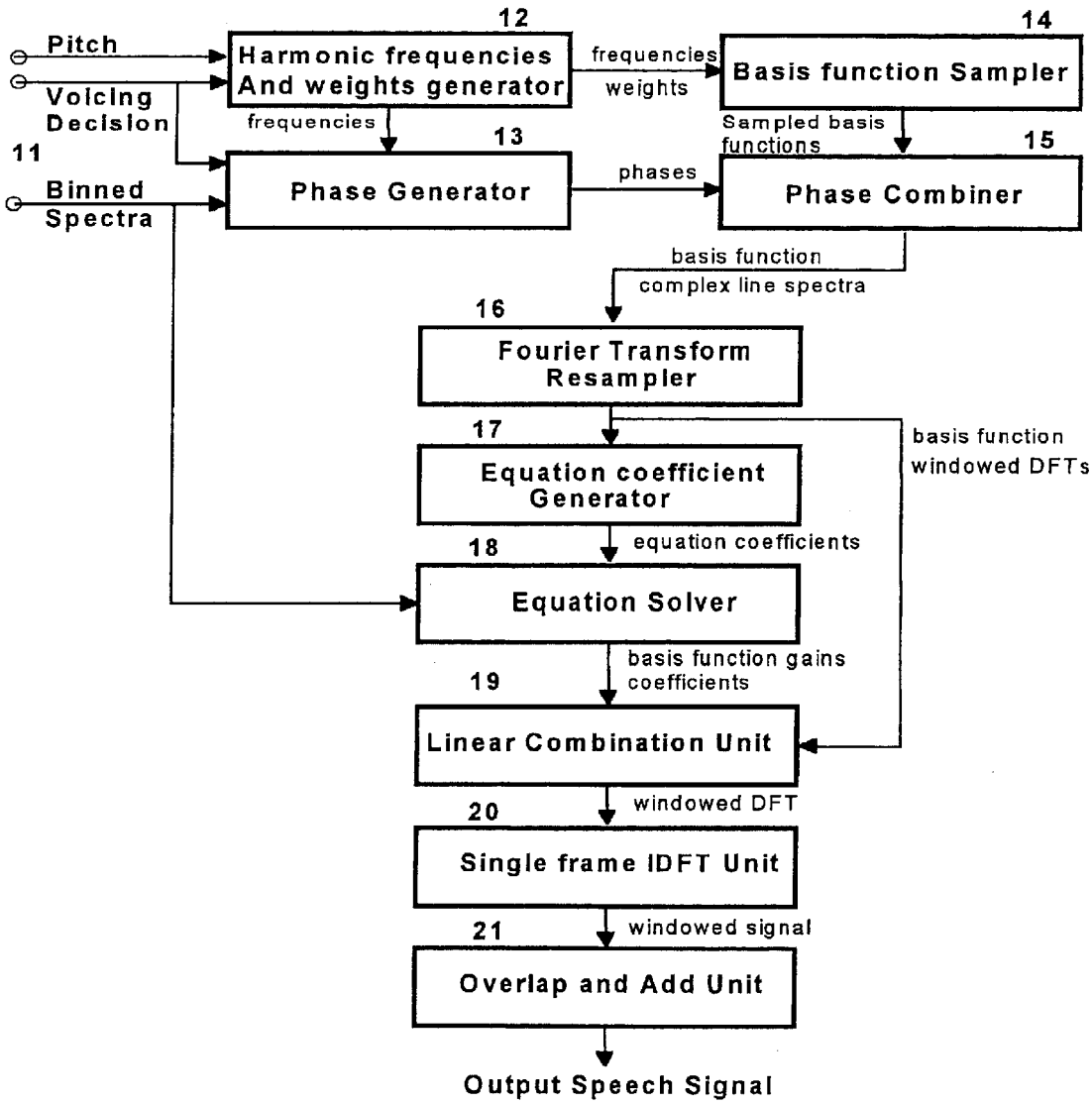
FIG. 2*a* is a block diagram showing functionally a speech reconstruction device employing the reconstruction algorithm according to the invention.

FIG. 2*a* shows functionally a speech reconstruction device 10 comprising an input stage 11 for inputting the binned spectra, pitch values and voicing decisions of the original input signal at successive instances of time. A harmonic frequencies and weights generator 12 is responsive to respective pitch values and voicing decision for generating harmonic frequencies and weights. The harmonic frequencies may be multiples of the corresponding pitch frequency for voiced frames, multiples of a fixed, sufficiently low, frequency for unvoiced frames or any combination of the two. The harmonic weights associated with the pitch frequencies are usually all set 1. Harmonics associated with the unvoiced part are assigned weights equal or lower than 1, depending on the degree of voicing in the frame. A phase generator 13 is responsive to the harmonic frequencies, voicing decision and possibly to the respective binned spectrum for generating a phase for each harmonic frequency. The phases may be generated by the method proposed by McAuley et al. ([5]). In the method of McAuley et al., the generated phase has two principal components. The first component is the excitation phase, which depends on the harmonic frequencies and voicing decisions. The second component is the vocal-tract phase, which can be derived from the binned spectrum when a minimum phase model is assumed. It has been experimentally found that while the first component is crucial, the second component is not—it may be used for enhancement of the reconstructed speech quality. Alternatively the second component may be discarded or a function of the harmonic frequencies and voicing decisions may be used, resulting in a phase that is dependent on the harmonic frequencies and voicing decisions and is independent of the binned spectrum.

Figure 2B:
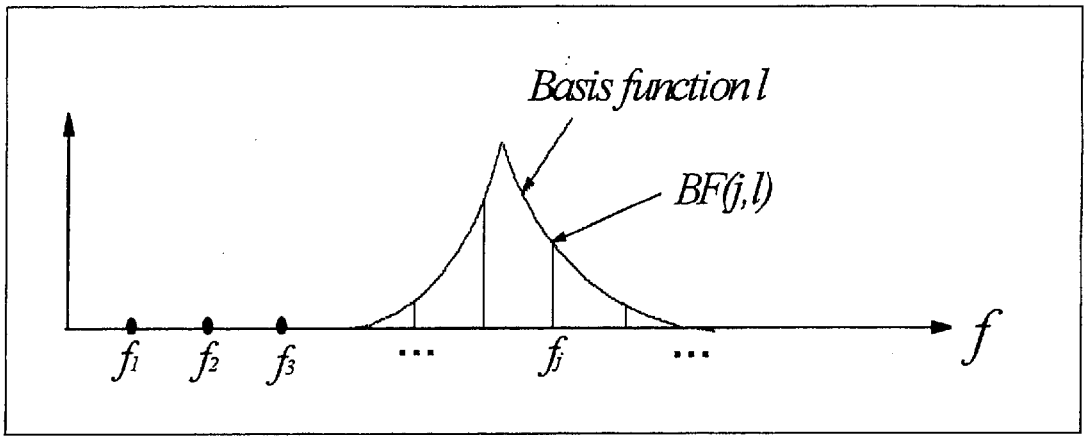
FIGS. 2*b* to 2*d* are graphical representations showing a basis function sampled at harmonic frequencies and a corresponding windowed discrete Fourier transform.

A basis function sampler 14 is responsive to the harmonic frequencies and the harmonic weights for sampling each of the basis functions at all harmonic frequencies which are within its support and multiplying the samples by the respective harmonic weights. The support of the basis functions is bounded and each basis function is associated with a respective central frequency f(i) as defined in the background section, so as to produce for each sampled basis function a respective line spectrum having multiple components. In the preferred embodiment, the basis functions BF(·,·) that were chosen are functions of the Mel scale weight filters BW(·,·) used for computing the bins:

$$BF(j,l)=0.4\cdot BW(j,l)+0.6\cdot BW(j,l)^2$$

where BW(j,l) is the $l^{th}$ mel scale weight function used for computing the bins evaluated at the $j^{th}$ harmonic frequency. FIG. 2*b* shows graphically the $l^{th}$ basis function and BF(j,l) the $l^{th}$ basis function sampled at a series of harmonic frequencies $f_j$.

Figure 2C:
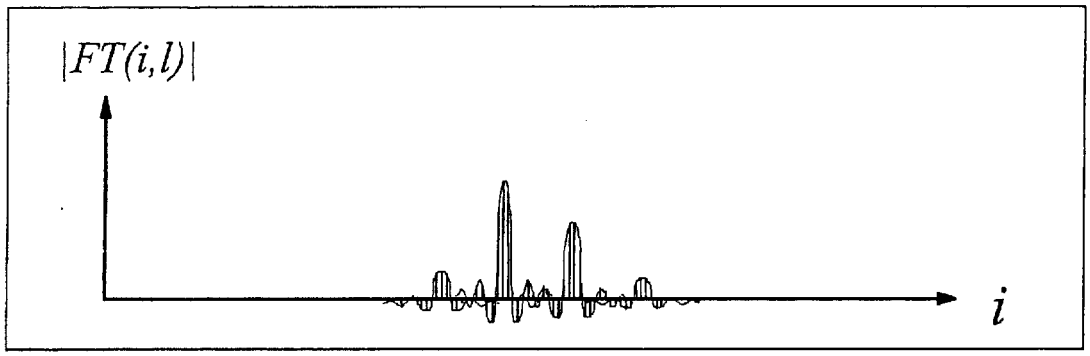
Figure 2D:
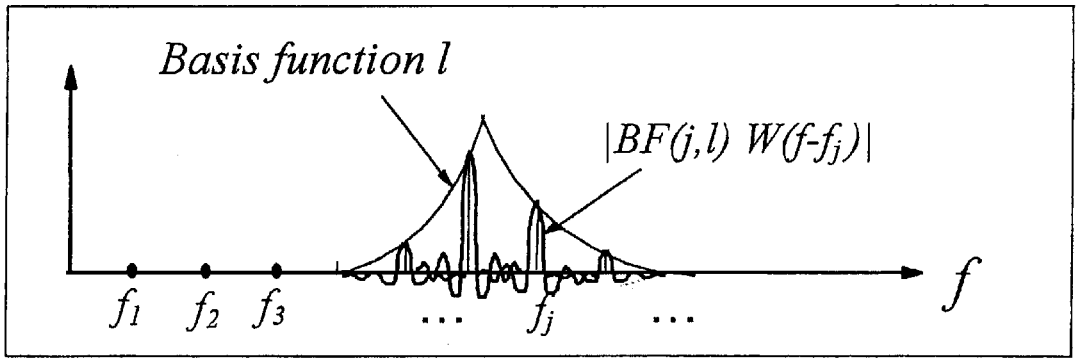

A phase combiner 15 is coupled to the basis function sampler 14 and the phase generator 13 for combining each component of the respective line spectrum with the respective phase thereof so as to produce a complex line spectrum for each basis function. The complex line spectra are fed to a Fourier transform resampler 16 which generates windowed complex DFTs of the basis functions: FT(i,l), where l is the basis function index and i is the DFT frequency index. The DFT FT(i,l), shown graphically in FIG. 2*c* is computed by convolving the complex line spectrum of the basis functions generated by the phase combiner 15 with the Fourier transform of the time window used in the analysis of the signal:

$$FT(i,l)=\Sigma BF(j,l)\cdot W(i\cdot f_0-f_j)$$

where W(f) is the Fourier transform of the window, $f_0$ is the DFT sampling resolution and Bf(j,l) is the $l^{th}$ basis function sampled at the $j^{th}$ harmonic frequency $f_j$, multiplied by the corresponding harmonic weight and combined with the corresponding phase. FIG. 2*d* shows graphically, the Fourier Transform of the window W(f), shifted in frequency to be centered around the $j^{th}$ harmonic frequency, multiplied by BF(j,l) and summed across all harmonic frequencies to perform a convolution operation. The absolute value of FT(i,l) approximates the spectral envelope of the signal whose complex line spectrum is the sampled $l^{th}$ basis function. An "equation coefficient generator" 17 coupled to the Fourier transform resampler 16 computes the basis function bins values BB(·,·). These values (for example, in a matrix form) will be used to build the expression to be minimized in the equation solver. These values are calculated according to:

$$BF(j,l)=0.4\cdot BW(j,l)+0.6\cdot BW(j,l)^2$$

where BW(j,l) is the $l^{th}$ mel scale weight function used for computing the bins evaluated at the $j^{th}$ harmonic frequency. FIG. 2*b* shows graphically the $l^{th}$ basis function and BF(j,l) the $l^{th}$ basis function sampled at a series of harmonic frequencies $f_j$.

An equation solver 18 receives the equation coefficients and generates the basis function gain coefficients. The equation solver 18 solves the equations for matching the bins of the regenerated spectrum to those of the original spectrum to the extent that this is possible, subject to the condition that the basis function gain coefficients are non negative. To obtain the basis function gain coefficients x(i) the following expression is minimized over x subject to the condition that the x(i) are non negative:

$$\min_x \sum_k \left(BI(k)-\sum_l x(l)\cdot BB(k,l)\right)^2$$

where BI(k) is the input binned spectrum. This problem may be solved using any number of iterative techniques, which will benefit from the fact that the matrix BB(k,l) is sparse.

A linear combination unit 19 is responsive to the solution coefficients and to the windowed DFTs of the basis functions from the Fourier transform resampler 16. The linear combination unit 19 functions as a weighted summer for multiplying each of the DFT points of each basis function by the coefficient of the basis function and summing up all the resulting functions to generate a windowed DFT for each frame of the reproduced speech:

$$\sum_l \{x(l)\cdot FT(i,l)\}.$$

The frame windowed DFT is fed to an IDFT unit 20, which computes the windowed time signal for that frame. A sequence of such windowed time signals is overlapped and added at the frame spacing by the overlap and add unit 21 to obtain the output speech signal.

The purpose of this approach is to generate a signal so that the bins computed on the reconstructed signal are identical to those of the original signal, and that the reconstructed signal has the same pitch as the original signal. Indeed, by definition the sum of the binned basis functions is as close as possible to the original bins, subject to the non-negativity constraint on the gain coefficients. However, the bins calculated by a weighted sum of the binned basis function are only an approximation of the true bins calculated on the reconstructed signal. This approximation is done to simplify the basis function gain coefficients search by making it a linear optimization problem. In practice, it turns out that bins computed on the reconstructed signal according to this scheme are very close to the original bins.

Figure 3:
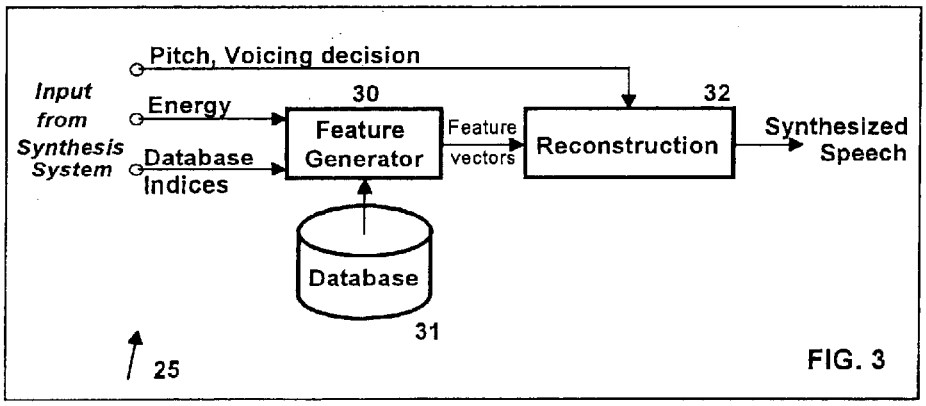
FIG. 3 is a block diagram showing functionally a speech generation device, which is part of a speech synthesis system, employing the reconstruction algorithm according to the invention.

FIG. 3 shows functionally a possible use of the reconstruction method described above in an output block 25 of a speech synthesis system. Input coming from the synthesis system comprises a series of indices of speech frames in a speech database, a series of respective energy values and a series of respective pitch values and voicing decisions. A feature generator 30 is responsive to the series of indices and the series of respective energy values for generating a series of respective feature vectors. The database 31 contains coded or uncoded feature vectors produced in advance from speech utterances. The feature generator 30 selects frames and corresponding feature vectors from the database 31, in accordance to the series of input database indices and adjusts their energy according to the respective input energy values. The sequentially generated feature vectors form a new series of feature vectors. The speech reconstruction unit 32 for generating the synthesized speech signal is responsive to the series of feature vectors and to the series of respective pitch values and voicing decisions. It operates as described above, with reference to FIG. 2*a*.

Figure 4:
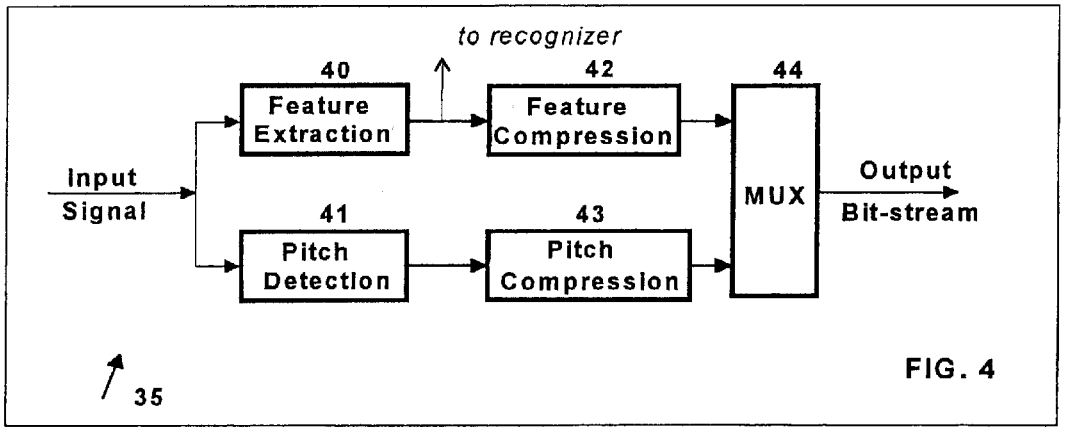
FIG. 4 is a block diagram showing functionally an encoder which is a part of speech coding/decoding system, wherein the decoder employs the reconstruction algorithm according to the invention.
Figure 5:
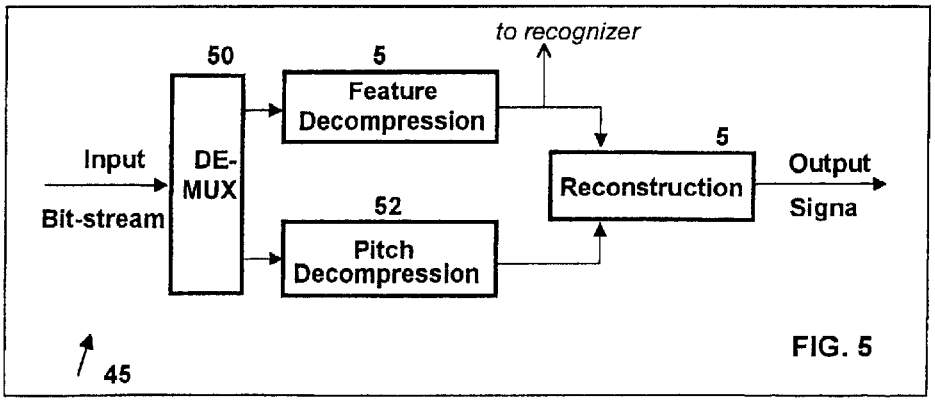
FIG. 5 is a block diagram showing functionally a decoder which is a part of speech coding/decoding system, employing the reconstruction algorithm according to the invention.

FIGS. 4 and 5 show functionally a speech coding/decoding system, wherein the speech decoder in FIG. 5 employs the reconstruction method described above.

FIG. 4 shows functionally an encoder 35 for encoding a speech signal so as to generate data capable of being decoded as speech by a decoder 45. An input speech signal is fed to a feature extraction unit 40 and to a pitch detection unit 41. The feature extraction unit 40 produces at its output MFCC feature vectors as known in the art, which may be used for speech recognition. The pitch detection unit 41 produces at its output pitch values and respective voicing decisions. A feature compression unit 42 is coupled to the feature extraction unit 40 for compressing the feature vector data. Likewise, a pitch compression unit 43 is coupled to the pitch detection unit 41 for compressing the pitch and voicing decision data. Standard quantization schemes known in the art may be used for the compression. The stream of compressed feature vectors and the stream of compressed pitch and voicing decisions are multiplexed together by a multiplexer 44, to form the output bit-stream.

FIG. 5 shows functionally the decoder 45 for decoding the bit-stream encoded by the encoder 35. The input bit-stream is fed to a demultiplexer 50, which separates the bit-stream into a stream of compressed feature vectors and a stream of compressed pitch and voicing decisions. A feature decompression unit 51 and a pitch decompression unit 52 are used to decode the feature vector data and the pitch and voicing decision data, respectively. The decoded feature vectors may be used for speech recognition. The speech reconstruction unit 53 for generating an output speech signal is responsive to the series of decoded feature vectors and to the series of respective decoded pitch values and voicing decisions. It operates as described above, with reference to FIG. 2*a*.

In addition to the above, the invention contemplates a dual-purpose speech recognition/playback system for voice recognition and reproduction of an encoded speech signal. Such a dual purpose speech recognition/playback system comprises a decoder as described above with reference to FIG. 4, and a recognition unit as is known in the art. The decoder decodes the bit stream using the reconstruction method as described above, in order to derive the speech signal, whilst the recognition unit may be used, for example, to convert the bit stream to text. Alternatively, the recognition unit may be mounted on a remote server in a distributed speech recognition system. Such a system comprises an encoder as described above with reference to FIG. 4, a recognition unit as is known in the art and a decoder as described above with reference to FIG. 5. The encoder encodes the speech and transmits the low bit rate bit stream, whilst the speech recognition unit receives the bit stream, converts it into text, and retransmits the text together with the low bit rate bit stream to a client. The client displays the text and may also decode and playback the speech using the reconstruction method as described above.

Figure 6:
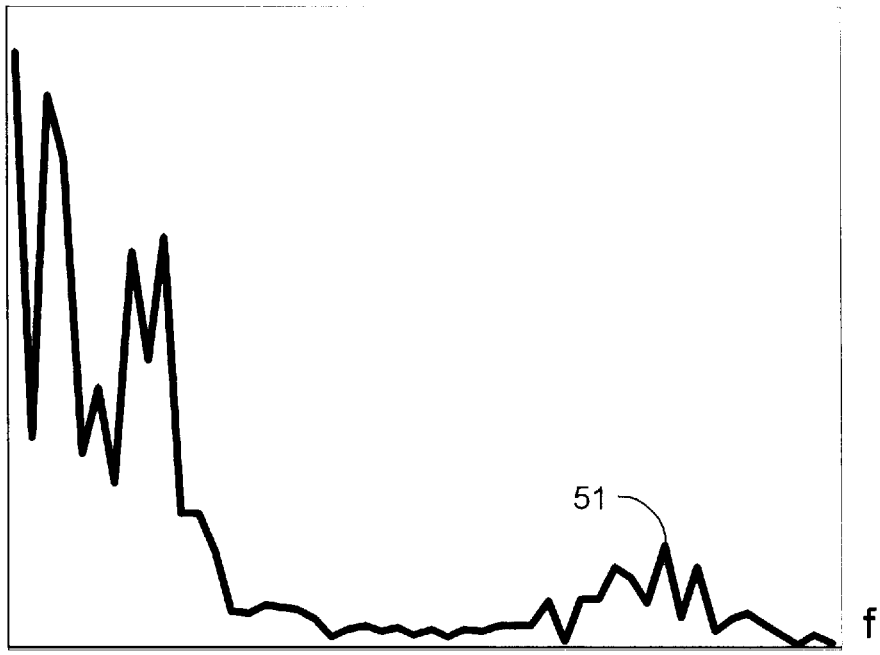
FIGS. 6 and 7 are waveforms showing respectively an estimate of the spectral envelope and the frequency domain window functions used during feature extraction superimposed thereon.
Figure 7:
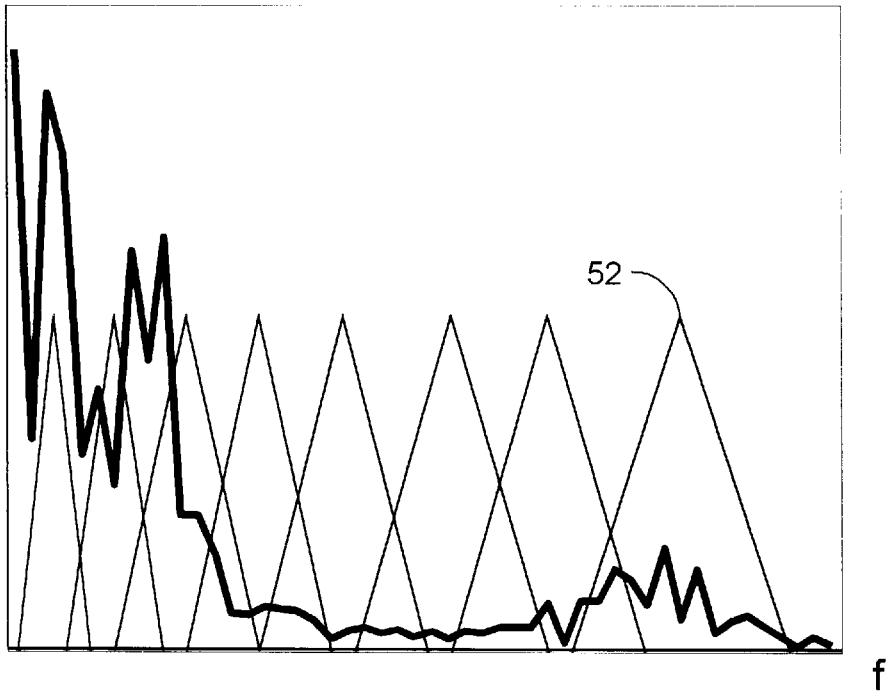

Although the preferred embodiment has been explained with regard to the use of Mel-Ceptsral feature vectors, it will be understood that feature vectors extracted by other analysis techniques may be used. FIGS. 6 and 7 show more generally the various stages in the conversion of a digitized speech signal to a series of feature vectors, by means of the following steps:

(i) deriving at successive instances of time of an estimate 51 of the spectral envelope of the digitized speech signal, (ii) multiplying each estimate of the spectral envelope by a predetermined set of frequency domain window functions 52, wherein each window is non zero over a narrow range of frequencies, and computing the integrals thereof, and (iii) assigning said integrals or a set of predetermined functions thereof to respective components of a corresponding feature vector in said series of feature vectors.

Thus, FIG. 6 shows derivation of the estimate 51 of the spectral envelope of the digitized speech signal at successive instances of time. In FIG. 7 the estimate 51 of the spectral envelope is multiplied by a predetermined set of frequency domain window functions 52. Each window function is non-zero over a narrow range of frequencies.

It will also be understood that the system according to the invention may be a suitably programmed computer. Likewise, the invention contemplates a computer program being readable by a computer for executing the method of the invention. The invention further contemplates a machine-readable memory tangibly embodying a program of instructions executable by the machine for executing the method of the invention.

In the method claims that follow, alphabetic characters used to designate claim steps are provided for convenience only and do not imply any particular order of performing the steps.

What is claimed is:

1. A speech reconstruction method for converting a series of feature vectors and a series of respective pitch values and voicing decisions of an original input speech signal into a speech signal, the feature vectors being obtained as follows:

i) deriving at successive instances of time an estimate of a spectral envelope SE(i), i being a frequency index, of the digitized original speech signal, ii) multiplying each estimate of the spectral envelope by a predetermined set of frequency domain window functions, BW(i,k), i being a frequency index and k being the window function index, wherein each window is non-zero over a narrow range of frequencies, and computing the integrals thereof, according to the expression:

$$BI(k) = \sum_i SE(i) \cdot BW(i, k),$$

where BI(k) is defined as the $k^{th}$ component or "bin" of a "binned spectrum", and iii) assigning said integrals or a set of pre-determined functions thereof to respective components of a corresponding feature vector in a series of feature vectors;

said speech reconstruction method comprising:

(a) converting each feature vector into a binned spectrum, (b) generating harmonic frequencies and weights according to the corresponding pitch and voicing decision, (c) generating for each harmonic frequency a respective phase, depending on the corresponding pitch value and voicing decision and possibly on the binned spectrum, (d) sampling a predetermined set of basis functions each being a function in a set of frequency domain functions with bounded supports at all harmonic frequencies which are within its support, and multiplying by the respective harmonic weight, so as to produce for each sampled basis function a respective line spectrum having multiple components, (e) combining each component of each respective line spectrum with the respective phase thereof so as to produce a complex line spectrum for each basis function, (f) generating gain coefficients of the basis functions, (g) multiplying the complex line spectrum of each basis function by the respective basis function gain coefficient, and summing up all resulting complex line spectra to generate a single complex line spectrum having a respective component for each of the harmonic frequencies, and (h) generating a time signal from complex line spectra computed at successive instances of time.

2. The method according to claim 1, wherein the step of generating the gain coefficients of the basis functions includes:

(i) determining the bins on the basis functions by computing directly or by an equivalent procedure the result of the following two steps:

i) converting each basis function into a single time frame signal by adding up the sine waves corresponding to the respective complex line spectrum, and ii) calculating the bins on the single time frame signal corresponding to each basis function in an identical manner as was done for the original signal; and (j) deriving and solving equations which express the condition that the gain coefficients of the basis functions are all non-negative, and that the sum of the binned basis functions weighted by their coefficients, is as close as possible in some norm to the bins of the original signal.

3. The method according to claim 2, wherein:

the frequency domain window functions BW(·,k) used for computing the binned spectrum are hat functions of the Mel Frequency spaced evenly on the Mel frequency axis, the feature vectors contain Mel frequency cepstral coefficients (MFCC) which are determined by computing the discrete cosine transform (DCT) of the log of the binned spectrum, and step (a) of converting the feature vector into a binned spectrum includes the step of computing the inverse DCT of the Mel Cepstral coefficients followed by antilog to obtain the binned spectrum.

4. The method according to claim 2, wherein the estimate of the spectral envelope of the signal SE(i), i being a frequency index corresponding to the $i^{th}$ discrete Fourier transform (DFT) index, is computed by taking the absolute value of the windowed Fourier transform of the signal, said method further including:

(k) computing the spectral envelope of each basis function, denoted by SEB(i,l), i being a frequency index corresponding to the $i^{th}$ discrete Fourier transform index and l being the index of the $l^{th}$ harmonic frequency, in accordance with:

$$SEB(i, l) = \left|\sum_j BF(j, l) \cdot W(i \cdot f_0 - f_j)\right|,$$

where W(f) is the Fourier transform of the window, $f_0$ is the DFT resolution and BF(j,l) is the $l^{th}$ basis function sampled at the $j^{th}$ harmonic frequency $f_j$, multiplied by the corresponding harmonic weight and combined with the corresponding phase, and (l) computing the binned basis functions, denoted by BB(k,l), k being the bin index and l being the basis function index, by integrating the spectral envelopes SEB(i,l) over the bin windows in accordance with:

$$BB(k, l) = \sum_i SEB(i, l) \cdot BW(i, k),$$

where BW(i,k) is the bin window function, i being a frequency index and k being the bin index, (m) generating the basis function coefficients x(l) by performing the following minimization:

$$\min_x \sum_k \left(\sum_l (x(l) \cdot BB(k, l) - BI(k))\right)^2$$

subject to $x(l) \geqq 0$, where x(l) is the $l^{th}$ solution coefficients and BI(k) is the $k^{th}$ component of the binned spectrum of the original speech signal.

5. The method according to claim 1, wherein the basis functions have bounded supports, and the union of the supports cover the same frequency range covered by the union of the supports of the frequency domain bin windows, used for computing the binned spectrum.

6. The method according to claim 5, wherein the $l^{th}$ basis function BF(·,l) is a convex function of the $l^{th}$ frequency domain bin window BW(·,l), used for computing the binned spectrum.

7. A method for accepting a series of indices of speech frames in a speech database, a series of respective pitch values and voicing decisions and a series of respective energy values, and generating speech therefrom, the method comprising:

(a) creating a database containing coded or uncoded feature vectors, the feature vectors being obtained as follows:

i) deriving at successive instances of time an estimate of the spectral envelope of the digitized original speech signal, ii) multiplying each estimate of the spectral envelope by a predetermined set of frequency domain window functions, wherein each window is non-zero over a narrow range of frequencies, and computing the integrals thereof, and iii) assigning said integrals or a set of pre-determined functions thereof to respective components of a corresponding feature vector in a series of feature vectors;

(b) producing a series of features vectors from frames selected from the database according to the series of indices and the series of respective energy values, and (c) reconstructing speech from the series of feature vectors and the series of respective pitch values and voicing decisions by:

i) converting each feature vector into a binned spectrum, ii) generating harmonic frequencies and weights according to the corresponding pitch and voicing decision, iii) generating for each harmonic frequency a respective phase, depending on the corresponding pitch value and voicing decision and possibly on the binned spectrum, iv) sampling a predetermined set of basis functions each being a function in a set of frequency domain functions with bounded supports at all harmonic frequencies which are within its support, and multiplying by the respective harmonic weight, so as to produce for each sampled basis function a respective line spectrum having multiple components, v) combining each component of each respective line spectrum with the respective phase thereof so as to produce a complex line spectrum for each basis function, vi) generating gain coefficients of the basis functions, vii) multiplying each complex line spectrum of each basis function by the respective basis function gain coefficient, and summing up all resulting complex line spectra to generate a single complex line spectrum having a respective component for each of the harmonic frequencies, and viii) generating a time signal from complex line spectra computed at successive instances of time.

8. A speech reconstruction device for converting a series of feature vectors and a series of respective pitch values and voicing decisions of an original input speech signal into a reconstructed speech signal, the feature vectors being obtained as follows:

(i) deriving at successive instances of time an estimate of a spectral envelope SE(i), i being a frequency index, of the digitized original speech signal, (ii) multiplying each estimate of the spectral envelope by a predetermined set of frequency domain window functions, BW(i,k), i being a frequency index and k being the window function index, wherein each window is non-zero over a narrow range of frequencies, and computing the integrals thereof, according to the expression:

$$BI(k) = \sum_i SE(i) \cdot BW(i, k)$$

where BI(k) is the $k^{th}$ component or "bin" of a "binned spectrum", and (iii) assigning said integrals or a set of pre-determined functions thereof to respective components of a corresponding feature vector in a series of feature vectors;

said device comprising:

an input stage for inputting said series of feature vectors and a respective series of pitch values and voicing decisions, and converting the feature vectors into binned spectra, a frequency and weight generator coupled to the input stage for generating harmonic frequencies and weights, a phase generator coupled to the input stage for generating phases for each harmonic frequency, a basis function sampler for sampling a predetermined set of basis functions each being a function in a set of frequency domain functions with bounded supports at all harmonic frequencies which are within its support, and multiplying by the respective harmonic weights, so as to produce for each sampled basis function a respective line spectrum having multiple components, a phase combiner coupled to the basis function sampler and the phase generator for combining each component of the respective line spectrum with the respective phase thereof so as to produce a complex line spectrum for each basis function, a coefficient generator for generating gain coefficients of the basis functions, a linear combination unit for multiplying each complex line spectrum of each basis function by the respective basis function gain coefficient and summing up all the resulting complex line spectra to generate a complex line spectrum with respective components for all harmonic frequencies, and a line spectrum to signal converter coupled to the linear combination unit for generating a time signal from a series of complex line spectra.

9. The device according to claim 8, wherein:

the frequency domain window functions BW(·,k) used to compute the binned spectrum are hat functions of the Mel Frequency spaced evenly on the Mel frequency axis, the feature vectors contain Mel frequency cepstral coefficients (MFCC) which are determined by computing the discrete cosine transform (DCT) of the log of the binned spectrum, and there is further provided a converter for converting the feature vector into a binned spectrum by computing the antilog of the inverse DCT of the Mel Cepstral coefficients.

10. The device according to claim 8, wherein the basis functions have bounded supports, and the union of the supports covers the same frequency range covered by the union of the supports of the frequency domain bin windows, used for computing the binned spectrum.

11. The device according to claim 10, wherein the $l^{th}$ basis function BF(·,l) is a convex function of the $l^{th}$ frequency domain bin window BW(·,l), used for computing the binned spectrum.

12. The device according to claim 8, including:

an equation coefficient generator coupled to the phase combiner for computing the bins of the basis functions by the following two step procedure or any other equivalent procedure:

i) converting each basis function into a single time frame signal by adding up the sine waves corresponding to its respective complex line spectrum, and ii) calculating the bins on the single time frame signal corresponding to each basis function in an identical manner as was done for the original signal; and an equation solver coupled to the equation coefficient generator for deriving and solving equations which express the condition that the coefficients of the basis functions are all non negative, and that the sum of the binned basis functions, weighted by their coefficients, is as close as possible in some norm to the bins of the original speech signal.

13. The device according to claim 12, wherein:

the estimate of the spectral envelope of the signal SE(i), i being a frequency index corresponding to the $i^{th}$ discrete Fourier transform (DFT) index, is computed by taking the absolute value of the windowed Fourier transform of the signal, and the equation coefficient generator for computing the binned basis functions includes:

a spectral envelope generator for generating a spectral envelope for each basis function, said spectral envelope denoted by SEB(i,l), i being a frequency index corresponding to the $i^{th}$ discrete Fourier transform index and l being the basis function index, according to the following expression:

$$SEB(i, l) = \left| \sum_j BF(j, l) \cdot W(i \cdot f_0 - f_j) \right|,$$

where W(f) is the Fourier transform of the window, $f_0$ is the DFT resolution and BF(j,l) is the $l^{th}$ basis function sampled at the $j^{th}$ harmonic frequency $f_j$, multiplied by the corresponding harmonic weight and combined with the corresponding phase, and an integrator for computing the bins of the basis functions, said bins denoted by BB(k,l), k being the bin index and l being the basis function index, by integrating the spectral envelopes SEB(i,l) over the bin windows in accordance with:

$$BB(k, l) = \sum_i SEB(i, l) \cdot BW(i, k),$$

where BW(i,k) is the bin window function, i being a frequency index and k being the bin index, and wherein the equation solver is adapted to perform the minimization:

$$\min_x \sum_k \left( BI(k) - \sum_l x(l) \cdot BB(k, l) \right)^2$$

subject to $x(l) \geqq 0$;

where x(l) is the $l^{th}$ solution coefficients and BI(k) is the $k^{th}$ component of the binned spectrum of the original speech signal.

14. A decoder for decoding speech, said decoder being responsive to a received bit stream representing an encoded series of feature vectors, pitch values and voicing decisions, the decoder including:

a decompression module for decompressing the series of respective feature vectors, pitch values and voicing decisions, a conversion unit for converting the feature vectors into binned spectra, a frequency and weight generator responsive to the pitch values and voicing decisions for generating harmonic frequencies and weights, a phase generator responsive to the pitch values, voicing decisions and possibly to the binned spectra for generating phases for each harmonic frequency, a basis function sampler for sampling a predetermined set of basis functions each being a function in a set of frequency domain functions with bounded supports at all harmonic frequencies which are within its support, and multiplying by the respective harmonic weights, so as to produce for each sampled basis function a respective line spectrum having multiple components, a phase combining device coupled to the basis function sampler and the phase generator for combining each component of the respective line spectrum with the respective phase thereof so as to produce a complex line spectrum for each basis function, a coefficient generator for generating gain coefficients of the basis functions, a linear combination unit for multiplying each complex line spectrum of each basis function by the respective basis function gain coefficient and summing up all the resulting complex line spectra to generate a complex line spectrum with respective components for all harmonic frequencies, and a line spectrum to signal converter coupled to the linear combination unit for generating a time signal from a series of complex line spectra.

15. A speech coding/decoding system comprising:

an encoder for coding speech, said encoder being responsive to an input speech signal and including:

a feature extraction module for computing feature vectors from the input speech signal at successive instances of time, the feature extraction module including:

a spectrum estimator for deriving at each said instances of time an estimate of the spectral envelope of the input speech signal.

an integrator coupled to the spectrum estimator for multiplying the spectral envelope by a predetermined set of frequency domain window functions, wherein each window occupies a narrow range of frequencies, and computing the integral thereof, and an assignment unit coupled to the integrator for deriving a set of predetermined functions of said integrals and assigning to respective components of a corresponding feature vector in said series of feature vectors;

a pitch detector for computing respective pitch values and voicing decisions at said successive instances of time, and a compression module for compressing the series of respective feature vectors, pitch values and voicing decisions into a bit-stream;

a decoder for decoding speech, said decoder being responsive to a received bit stream representing an encoded series of respective feature vectors, pitch values and voicing decisions, the decoder including:

a decompression module for decompressing the series of respective feature vectors, pitch values and voicing decisions, a conversion unit for converting the feature vectors into binned spectra, a frequency and weight generator responsive to the pitch values and voicing decisions for generating harmonic frequencies and weights, a phase generator responsive to the pitch values, voicing decisions and possibly to the binned spectra for generating phases for each harmonic frequency, a basis function sampler for sampling a predetermined set of basis functions each being a function in a set of frequency domain functions with bounded supports at all harmonic frequencies which are within its support, and multiplying by the respective harmonic weights, so as to produce for each sampled basis function a respective line spectrum having multiple components, a phase combining device coupled to the basis function sampler and the phase generator for combining each component of the respective line spectrum with the respective phase thereof so as to produce a complex line spectrum for each basis function, a coefficient generator for generating gain coefficients of the basis functions, a linear combination unit for multiplying each complex line spectrum of each basis function by the respective basis function gain coefficient and summing up all the resulting complex line spectra to generate a complex line spectrum with respective components for all harmonic frequencies, and a line spectrum to signal converter coupled to the linear combination unit for generating a time signal from a series of complex line spectra.

16. A dual purpose speech recognition/playback system, for continuous speech recognition and reproduction of an encoded speech signal, said system comprising a decoder and a recognition unit:

the decoder for decoding and playback of encoded speech being responsive to a received bit stream representing an encoded series of respective feature vectors, pitch values and voicing decisions, the decoder including:

a decompression module for decompressing the series of respective feature vectors, pitch values and voicing decisions, a conversion unit for converting the feature vectors into binned spectra, a frequency and weight generator responsive to the pitch values and voicing decisions for generating harmonic frequencies and weights, a phase generator responsive to the pitch values, voicing decisions and possibly to the binned spectra for generating phases for each harmonic frequency, a basis function sampler for sampling a predetermined set of basis functions each being a function in a set of frequency domain functions with bounded supports at all harmonic frequencies which are within its support, and multiplying by the respective harmonic weights, so as to produce for each sampled basis function a respective line spectrum having multiple components, a phase combining device coupled to the basis function sampler and the phase generator for combining each component of the respective line spectrum with the respective phase thereof so as to produce a complex line spectrum for each basis function, a coefficient generator for generating gain coefficients of the basis functions, a linear combination unit for multiplying each complex line spectrum of each basis function by the respective basis function gain coefficient and summing up all the resulting complex line spectra to generate a complex line spectrum with respective components for all harmonic frequencies, and a line spectrum to signal converter coupled to the linear combination unit for generating a time signal from a series of complex line spectra; and the recognition unit being responsive to the decompressed feature vectors for continuous speech recognition.

17. The dual purpose recognition/playback system of claim 16, wherein the recognition unit is further responsive to the decompressed pitch values and voicing decisions for continuous speech recognition.

18. A speech recognition system comprising:

an encoder for coding speech so as to derive low bit rate bit stream, said encoder being responsive to an input speech signal and including:

a feature extraction module for computing feature vectors from the input speech signal at successive instances of time, the feature extraction module including:

a spectrum estimator for deriving at each said instances of time an estimate of the spectral envelope of the input speech signal, an integrator coupled to the spectrum estimator for multiplying the spectral envelope by a predetermined set of frequency domain window function, wherein each window occupies a narrow range of frequencies, and computing the integral thereof, and an assignment unit coupled to the integrator for deriving a set of predetermined functions of said integrals and assigning to respective components of a corresponding feature vector in said series of feature vectors;

a pitch detector for computing respective pitch values and voicing decisions at said successive instances of time, a compression module for compressing the series of respective feature vectors, pitch values and voicing decisions into a bit-stream, a transmitter coupled to the encoder for transmitting the low bit rate bit stream, a recognition unit responsive to the low bit rate bit stream for decompressing the feature vectors and performing continuous speech recognition on the feature vectors, and a transmitter within the speech recognition unit for retransmitting the results of the recognition and the low bit rate bit stream to a remote device for displaying the results of the recognition;

said remote device including a speech decoder, comprising:

a decompression module for decompressing the series of respective feature vectors, pitch values and voicing decisions, a conversion unit for converting the feature vectors into binned spectra, a frequency and weight generator responsive to the pitch values and voicing decisions for generating harmonic frequencies and weights, a phase generator responsive to the pitch values, voicing decisions and possibly to the binned spectra for generating phases for each harmonic frequency, a basis function sampler for sampling a predetermined set of basis functions each being a function in a set of frequency domain functions with bounded supports at all harmonic frequencies which are within its support, and multiplying by the respective harmonic weights, so as to produce for each sampled basis function a respective line spectrum having multiple components, a phase combiner coupled to the basis function sampler and the phase generator for combining each component of the respective line spectrum with the respective phase thereof so as to produce a complex line spectrum for each basis function, a coefficient generator for generating gain coefficients of the basis functions, a linear combination unit for multiplying each complex line spectrum of each basis function by the respective basis function gain coefficient and summing up all the resulting complex line spectra to generate a complex line spectrum with respective components for all harmonic frequencies, and a line spectrum to signal converter coupled to the linear combination unit for generating a time signal from a series of complex line spectra.

19. The recognition system of claim 18, wherein:

the recognition unit is adapted to decompress and use the pitch values and voicing decisions in addition to the decompressed feature vectors for continuous speech recognition.

20. A speech generator for accepting a series of indices of speech frames in a speech database, a series of respective pitch values and voicing decisions and a series of respective energy values and generating speech, the device comprising:

a database containing coded or uncoded feature vectors, the feature vectors being obtained as follows:

i) deriving at successive instances of time an estimate of the spectral envelope of the digitized original speech signal, ii) multiplying each estimate of the spectral envelope by a predetermined set of frequency domain window functions, wherein each window is non-zero over a narrow range of frequencies, and computing the integrals thereof, and iii) assigning said integrals or a set of predetermined functions thereof to respective components of a corresponding feature vector in a series of feature vectors;

a features generator responsive to the series of indices and the series of respective energy values for producing a series of feature vectors using frames selected from the database, and a speech reconstruction unit for reconstructing speech from a series of features vectors and the series of respective pitch values and voicing decisions, said reconstruction unit comprising:

a conversion unit for converting the feature vectors into binned spectra, a frequency and weight generator responsive to the pitch values and voicing decisions for generating harmonic frequencies and weights, a phase generator responsive to the pitch values, voicing decisions and possibly to the binned spectra for generating phases for each harmonic frequency, a basis function sampler for sampling a predetermined set of basis functions each being a function in a set of frequency domain functions with bounded supports at all harmonic frequencies which are within its support, and multiplying by the respective harmonic weights, so as to produce for each sampled basis function a respective line spectrum having multiple components, a phase combiner coupled to the basis function sampler and the phase generator for combining each component of the respective line spectrum with the respective phase thereof so as to produce a complex line spectrum for each basis function, a coefficient generator for generating gain coefficients of the basis functions, a linear combination unit for multiplying each complex line spectrum of each basis function by the respective basis function gain coefficient and summing up all the resulting complex line spectra to generate a complex line spectrum with respective components for all harmonic frequencies, and a line spectrum to signal converter coupled to the linear combination unit for generating a time signal from a series of complex line spectra.

21. The speech generator according to claim 20, being an output block of a speech synthesis system.

22. A computer program product comprising a computer useable medium having computer readable program code embodied therein for converting a series of feature vectors and a series of respective pitch values and voicing decisions of an original input speech signal into a reconstructed speech signal, the feature vectors being obtained as follows:

i) deriving at successive instances of time an estimate of the spectral envelope of the digitized original speech signal, ii) multiplying each estimate of the spectral envelope by a predetermined set of frequency domain window functions, wherein each window is non-zero over a narrow range of frequencies, and computing the integrals thereof, and iii) assigning said integrals or a set of predetermined functions thereof to respective components of a corresponding feature vector in a series of feature vectors;

said computer program product comprising:

computer readable program code for inputting said series of feature vectors and a respective series of pitch values and voicing decisions, and converting the feature vectors into binned spectra, computer readable program code for causing the computer to generate harmonic frequencies and weights according to the pitch value and voicing decision, computer readable program code for causing the computer to generate phases for each harmonic frequency depending on the pitch value, voicing decision and possibly on the binned spectrum, computer readable program code for causing the computer to sample a predetermined set of basis functions each being a function in a set of frequency domain functions with bounded supports at all harmonic frequencies which are within its support, and multiply by the respective harmonic weights, so as to produce for each sampled basis function a respective line spectrum having multiple components, computer readable program code for causing the computer to combine each component of the respective line spectrum with the respective phase thereof so as to produce a complex line spectrum for each basis function, computer readable program code for causing the computer to generate coefficients of the basis functions, computer readable program code for causing the computer to multiply each complex line spectrum of each basis function by the respective basis function coefficient and sum up all the resulting complex line spectra to generate a complex line spectrum with respective components for all harmonic frequencies, and computer readable program code for causing the computer to generate a time signal from a series of complex line spectra.

23. A program storage device readable by machine, tangibly embodying a program of instructions executable by the machine to perform method steps for converting a series of feature vectors and a series of respective pitch values and voicing decisions of an original input speech signal into a reconstructed speech signal, the feature vectors being obtained as follows:

i) deriving at successive instances of time an estimate of the spectral envelope of the digitized original speech signal, ii) multiplying each estimate of the spectral envelope by a predetermined set of frequency domain window functions, wherein each window is non-zero over a narrow range of frequencies, and computing the integrals thereof, and iii) assigning said integrals or a set of pre-determined functions thereof to respective components of a corresponding feature vector in a series of feature vectors, said method steps comprising:

(a) converting each feature vector into a binned spectrum, (b) generating harmonic frequencies and weights according to the corresponding pitch and voicing decision, (c) generating for each harmonic frequency a respective phase, depending on the corresponding pitch value and voicing decision and possibly on the binned spectrum, (d) sampling a predetermined set of basis functions each being a function in a set of frequency domain functions with bounded supports at all harmonic frequencies which are within its support, and multiplying by the respective harmonic weight, so as to produce for each sampled basis function a respective line spectrum having multiple components, (e) combining each component of each respective line spectrum with the respective phase thereof so as to produce a complex line spectrum for each basis function, (f) generating gain coefficients of the basis functions, (g) multiplying each complex line spectrum of each basis function by the respective basis function gain coefficient, and summing up all resulting complex line spectra to generate a single complex line spectrum having a respective component for each of the harmonic frequencies, and (h) generating a time signal from complex line spectra computed at successive instances of time.

24. The program storage device according to claim 23, wherein the method steps executable by the machine for generating the gain coefficients of the basis functions include:

(i) determining bin values on the basis functions by computing directly or by an equivalent procedure the result of the following two steps:

i) converting each basis function into a single time frame signal by adding up the sine waves corresponding to the respective complex line spectrum, and ii) calculating the binned basis functions on the single time frame signal corresponding to each basis function in an identical manner as was done for the original signal, and (j) deriving and solving equations which express the condition that the gain coefficients of the basis functions are all non-negative, and that the sum of the binned basis functions weighted by their coefficients, is as close as possible in some norm to the bin values of the original signal.

* * * * *